US007661564B2

(12) United States Patent
Delbarre

(10) Patent No.: US 7,661,564 B2
(45) **Date of Patent: *Feb. 16, 2010**

(54) CASK FOR DRAWING OFF LIQUIDS UNDER THE EFFECT OF PRESSURE

(75) Inventor: Denis Delbarre, Beuvry (FR)

(73) Assignee: ODIN (A French Private Limited Company), Beuvry (FR)

( * ) Notice: Subject to any disclaimer, the term of this patent is extended or adjusted under 35 U.S.C. 154(b) by 253 days.

This patent is subject to a terminal disclaimer.

(21) Appl. No.: 11/154,111

(22) Filed: Jun. 15, 2005

(65) Prior Publication Data

US 2005/0230435 A1 Oct. 20, 2005

Related U.S. Application Data

(63) Continuation of application No. 10/416,093, filed as application No. PCT/FR01/03484 on Nov. 9, 2001.

(30) Foreign Application Priority Data

Nov. 10, 2000 (FR) ..... 00 01446

(51) Int. Cl.
*B65D 83/00* (2006.01)

(52) U.S. Cl. ..... 222/400.7; 222/1; 222/143; 222/399; 137/212

(58) Field of Classification Search ..... 222/400.7, 222/400.8, 396–397, 399, 484, 542, 143, 222/1; 137/212, 320–322
See application file for complete search history.

(56) References Cited

U.S. PATENT DOCUMENTS 2,613,462 A 10/1952 Johnson
2,983,403 A 5/1961 Mauser
3,563,423 A 2/1971 Wilson
3,776,260 A 12/1973 Ruddick
3,914,520 A 10/1975 Hovey
3,937,246 A * 2/1976 Schots ..... 137/322
3,939,860 A * 2/1976 Golding ..... 137/212
4,142,658 A 3/1979 Golding
4,282,974 A 8/1981 Quandel (Continued)

FOREIGN PATENT DOCUMENTS

EP 1516133 6/1978

(Continued)

*Primary Examiner*—Frederick C. Nicolas
(74) *Attorney, Agent, or Firm*—Larson & Anderson, LLC

(57) ABSTRACT

A keg is formed from (A) a shaped jacket or liner forming a container, obtained from at least two nonsymmetrical parts (1*a*, 1*b*) welded together, one of the parts containing an opening provided with a neck, and (B) a filling/tapping device (3) positioned in the neck of the opening. The part of the container with the filling/tapping opening contains a riser or peripheral skirt (13) having a height at least equal to that of the outer part of the filling/tapping device and, optionally, sufficient to contain at least one cut-out forming a handle, and while the neck of the opening contains a part (9) extending inside the lumen of the jacket and having a limited diameter at its end (10), so as to permit passage and maintenance of the tapping device (3), and containing at least one other opening (11), advantageously on the periphery of the opening for passage and maintenance of the tapping device.

16 Claims, 7 Drawing Sheets

U.S. PATENT DOCUMENTS

| | | | | |
|---|---|---|---|---|
| 4,368,831 | A | 1/1983 | Bailey | |
| 4,450,853 | A | 5/1984 | Dessenoix et al. | |
| 4,573,603 | A | 3/1986 | Starling et al. | |
| 4,838,419 | A * | 6/1989 | Weits et al. | 206/386 |
| 4,909,289 | A * | 3/1990 | Hagan et al. | 141/302 |
| 5,203,477 | A | 4/1993 | Lo | |
| 5,415,329 | A | 5/1995 | Westlund | |
| 5,511,692 | A | 4/1996 | Willingham | |
| 5,833,098 | A | 11/1998 | Gomi | |
| 6,308,869 | B1 | 10/2001 | Simpson | |
| 7,168,596 | B2 * | 1/2007 | Delbarre | 222/400.7 |

FOREIGN PATENT DOCUMENTS

| | | |
|---|---|---|
| EP | 0162117 | 2/1984 |
| EP | 0294095 A1 | 7/1988 |
| FR | 2776637 | 3/1998 |

* cited by examiner

CASK FOR DRAWING OFF LIQUIDS UNDER THE EFFECT OF PRESSURE

This application is a continuation of U.S. patent application Ser. No. 10/416,093 filed Mar. 5, 2003, which is a 371 national phase of PCT Application No. PCT/FR/01/03484 filed Nov. 9, 2001.

BACKGROUND OF THE INVENTION

The invention concerns the transportation, storage and supply of beverages, notably carbonated beverages such as beer and the like, to soft drink manufacturers and/or to the consumer. It concerns, in particular, a container, also referred to below as "keg," for transporting, storing and drawing off beverages under the effect of pressure.

The invention thus especially concerns a keg for one-time use or a disposable keg and, in particular, a disposable keg for liquids under pressure, notably for beer.

To simplify matters, the invention will be described below with reference to a beer keg, but it is clear that this use in no way limits the scope and range of the invention. The invention more generally applies, in fact, to any liquid intended to be tapped from a keg, which tapping can then be carried out under the own pressure of the liquid contained in the keg and/or under the pressure of a gas introduced in the latter on the tapping operation, as, for example, in racking wine with nitrogen under pressure.

Patent FR-A 2,719,285 describes a container for fluid under internal pressure, consisting of the combination of a chamber for the fluid, an outer jacket defining a space with said chamber and a layer of a material filling said space. According to working variants of that product, the outer jacket and the material filling said space can be made of the same material and have a structure cast in one piece. Tapping of the liquid in that container can be carried out in the traditional matter by means of a plunger tube of known type, which contains the openings necessary for entry of the tapping gas, while the liquid drawn off is extracted through the plunger tube of said pipe.

According to patent EP-A 0,162,117, containers are known which are utilized as washable and reusable beer kegs, consisting of two halves formed by injection molding and welded together along a line forming a median peripheral line of the keg thus formed. The keg in question contains a plunging collar which constitutes a tapping pipe head support and which either forms one and the same piece with the upper part of the keg, and, in that case, all of the pipe head pieces must be forcibly mounted at the top, with the risk of deformation and loss of tightness, or is a piece attached and glued or welded, and in that case, the pipe head assembly must be mounted from the inside, before welding of the second half of the keg to the first half.

As for patent FR-A 2,776,637, it describes a container for one-time use with tapping pipe, in which the chamber for the fluid and the filling and/or tapping device present a monolithic structure. The pipe is not held inside the container. It is tightly joined to the neck of the container by fastening on the latter as soon as it is hot-stripped and under the effect of the shrinkage that said neck undergoes on cooling.

A need therefore existed for a container useful notably as a beer keg, having a simple structure in order to make it possible to lower its production cost and containing means for filling and/or tapping its contents. A need further existed for such a beer keg which could be a disposable keg, that is, non-reusable and the materials of which could, however, be recycled. It has now been found that these objectives can be accomplished, together with others which will become more apparent from the description that follows, thanks to a container for fluid, preferably for liquid under pressure, constituting a keg made of thermoplastic material and shaped preferably by injection molding, containing within its space an arrangement of means capable of making possible filling with a fluid, preservation and transportation of said container, as well as tapping of the fluid by pressurization of the interior volume of said container.

SUMMARY OF THE INVENTION

The keg according to the invention comprises:

(A) a shaped jacket (or liner) forming a container, obtained from at least two nonsymmetrical parts welded together, preferably formed by injection molding of a thermoplastic material, one of said parts containing an opening provided with a neck, and (B) a filling/tapping device positioned in the neck of said opening, while the part of the container with the filling/tapping opening contains a riser or peripheral skirt having a height at least equal to that of the outer part of said filling/tapping device and, as an option, sufficient to be able to contain a cut-out forming a handle, and while the said neck of said opening contains a part extending inside the space of said jacket and having a limited diameter at its end, so as to permit passage and maintenance of the tapping device, and containing at least one other opening, advantageously on the periphery of said opening for passage and maintenance of the tapping device.

From a first aspect, the invention thus involves a container for the transportation, storage and supply of liquids, notably, carbonated and/or fermented beverages such as beer, said container having a jacket and at least two parts, such as defined above and at least one of which parts contains an opening and, as an option, a filling/tapping device integrated fixedly or removably with the neck of said opening.

BRIEF DESCRIPTION OF THE DRAWINGS

The invention is described below more in detail, with reference to the attached drawings, in which.

In the figures, the same reference numbers are used for identical or practically similar pieces, at least from the functional standpoint.

DETAILED DESCRIPTION OF THE INVENTION

Figure 1:
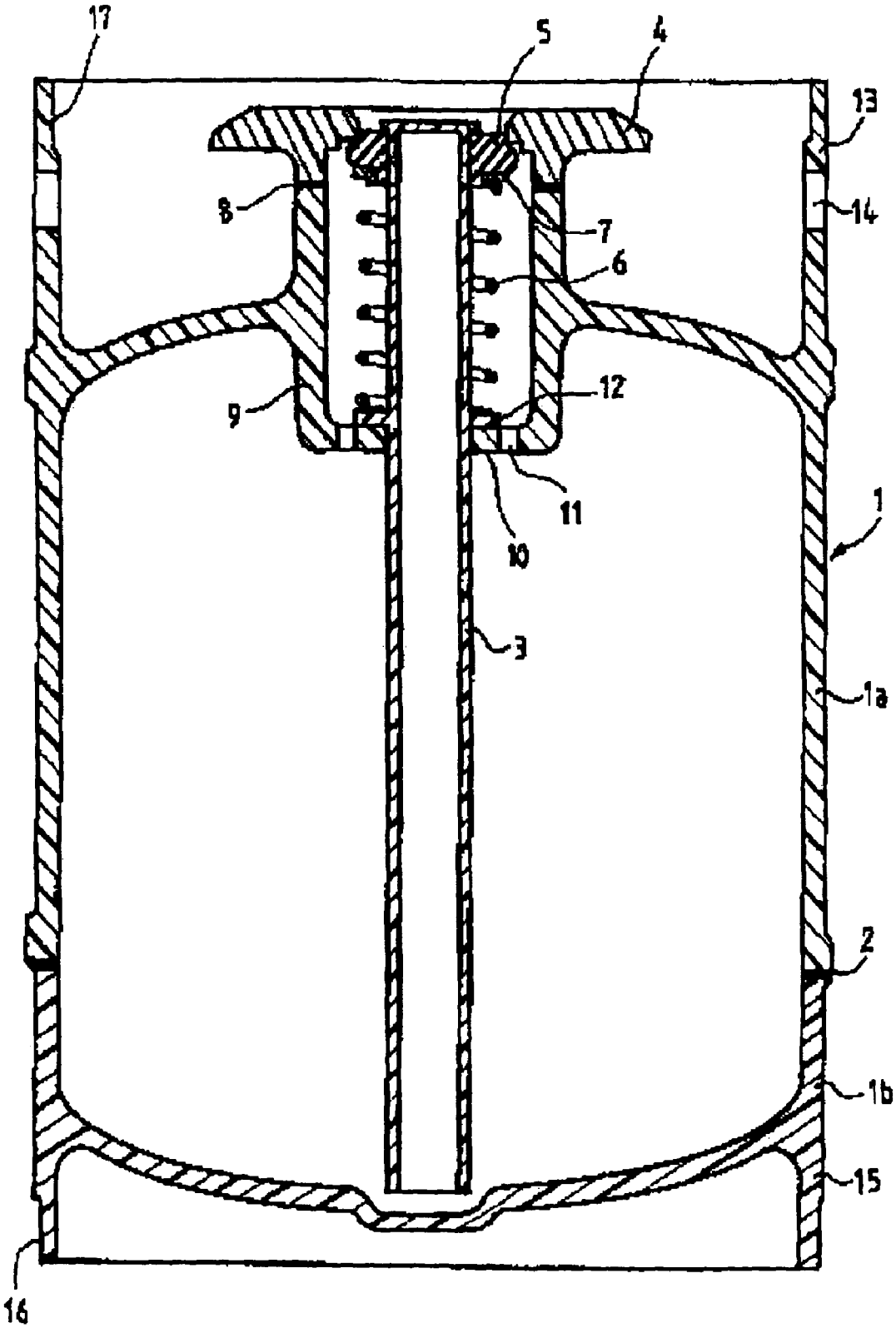
FIG. 1 represents a longitudinal schematic section of a container according to the invention.

A container 1 according to this invention is, first of all, described below in general with reference to FIG. 1 of the attached drawings, where the container 1 is composed of a jacket or liner preferably of thermoplastic material. It is recommended that this material be of alimentary quality. Otherwise or in addition, said jacket can be lined with substances capable of affording it the alimentary characteristics required.

The material of the jacket is advantageously compact enough for the gases to be able to be unable, or practically unable, to migrate across it. Furthermore, it is preferable for that material to be opaque to visible light and/or to UV radiation, so that it can serve as a UV barrier, when that is necessary or sought.

By way of non-limiting example, one can mention as suitable materials for said jacket the thermoplastic polymers chosen in the group consisting of thermoplastic materials like high-density polyethylene (HDPE), polypropylene (PP), polyvinyl chloride (PVC) and polyacrylontrile/butadiene/styrene (ABS).

In one embodiment, the keg or container 1 according to the invention can further contain an outer covering to improve tightness, notably gas tightness. It has, in fact, been found that, under certain extreme conditions, the materials of those products could present a degree of porosity. Without wanting to be bound by any theory, one might think that the air at atmospheric pressure (ordinarily containing nitrogen, oxygen, carbon dioxide, water vapor, argon, rare gases and microscopic dust in suspension) can cross the thickness of the container from outside to inside and encounter under that pressure other gaseous components, which were created on use of the container or of its constituent materials and might have been maintained there. The outer thrust thus exerted tends to carry along those secondary components of the container material with the air and the components of the latter indicated above. This can result in one or more chemical reactions, the products of which can impart an odor inside the container 1.

In one embodiment of the invention, it is arranged to treat that phenomenon by creating an outer barrier around the container 1, advantageously by projection or thermal spraying of metal dust over all or part of the outer faces of the container 1, so as to coat them with a covering of thickness and density sufficient to create effective tightness against the effects of the atmospheric pressure indicated above. With that covering, the formation and development of parasite odors in the container 1 are thus avoided, annihilating what is called the "Dalton effect" in plastics technology.

The expert is capable of defining the most advantageous parameters for that metal plating and, notably, the choice of metal, its physical form and the thickness and density of the covering, as well as the method and temperature of application, undertaking routine tests, if necessary. Two preferred forms for said jacket are represented in longitudinal section on FIGS. 1-5 and 6, respectively.

It is advantageous to make the jacket intended to form the container 1 by injection molding or by any equivalent means. The essential thing is for the jacket thus produced to have sufficiently constant and continuous dimensional characteristics, so that welding of the two parts of the jacket and fitting of the accessories, notably of the tapping and/or plugging devices, will be carried out easily.

In the embodiment represented in FIGS. 1-5, the jacket comprises two parts 1*a* and 1*b* complementing each other and intended to be welded or joined in any other appropriate manner in order to form a container 1.

The two jacket parts 1*a* and 1*b* are joined preferably by a weld seam 2 or by any other equivalent means. Thus, the pieces 1*a* and 1*b*, which are injected separately, are joined together along an appropriate contact surface or welding surface 2.

The wall thickness of the jacket can be constant or variable. The expert is able, by means of preliminary tests, to examine and determine case by case the thicknesses and possible variation of thickness most appropriate for an optimal result. According to one preferred embodiment, that thickness is constant over the set of parts 1*a* and 1*b* of the container 1, except on two peripheral areas where it is reinforced, so as to define external beads, which can serve as rolling bands, when the keg is turned 90° in order to be rolled on the ground. Those reinforcing bands are then spaced and positioned symmetrically in relation to the center of gravity of the keg. It is further advantageous for one of those reinforcing and/or rolling bands to coincide with the area containing the welding surface of one of parts 1*a* or 1*b*, so as also to accentuate the width of said band for welding parts 1*a* and 1*b* together.

As a variant, the container 1 could be composed of more than two parts joined together by welding or any equivalent means. However, it is economically preferable to limit the number of jacket parts joined by welding to two.

In one embodiment, the neck of the opening of the container 1 according to the invention can consist of a separate piece, then fastened by appropriate means, such as welding or the like, on part 1*a* of the container. Said part 1*a* must then have an adequate geometry and dimensions. The container 1 constitutes an essential part of the keg, which still needs to contain, in order to be rendered operational, a plunger tube 3, also called filling/tapping pipe.

In the container according to the invention, as represented in FIGS. 1-5 by way of example, the plunger tube 3 is further equipped with a head 4, 18 and, in immediate proximity thereto, a peripheral gasket 5, as well as at least one spring 6 and a support piece 7 having the function of compressing the return spring and/or alternately blocking and freeing discharge openings for the liquid in the container 1 by control of the user.

The plunger tube 3, intended to permit tapping of the liquid in the container 1, has an opening at its end plunging to the bottom of the container 1 and at least one preferably lateral opening at the top at the level of the above-mentioned gasket 5.

Figure 2:
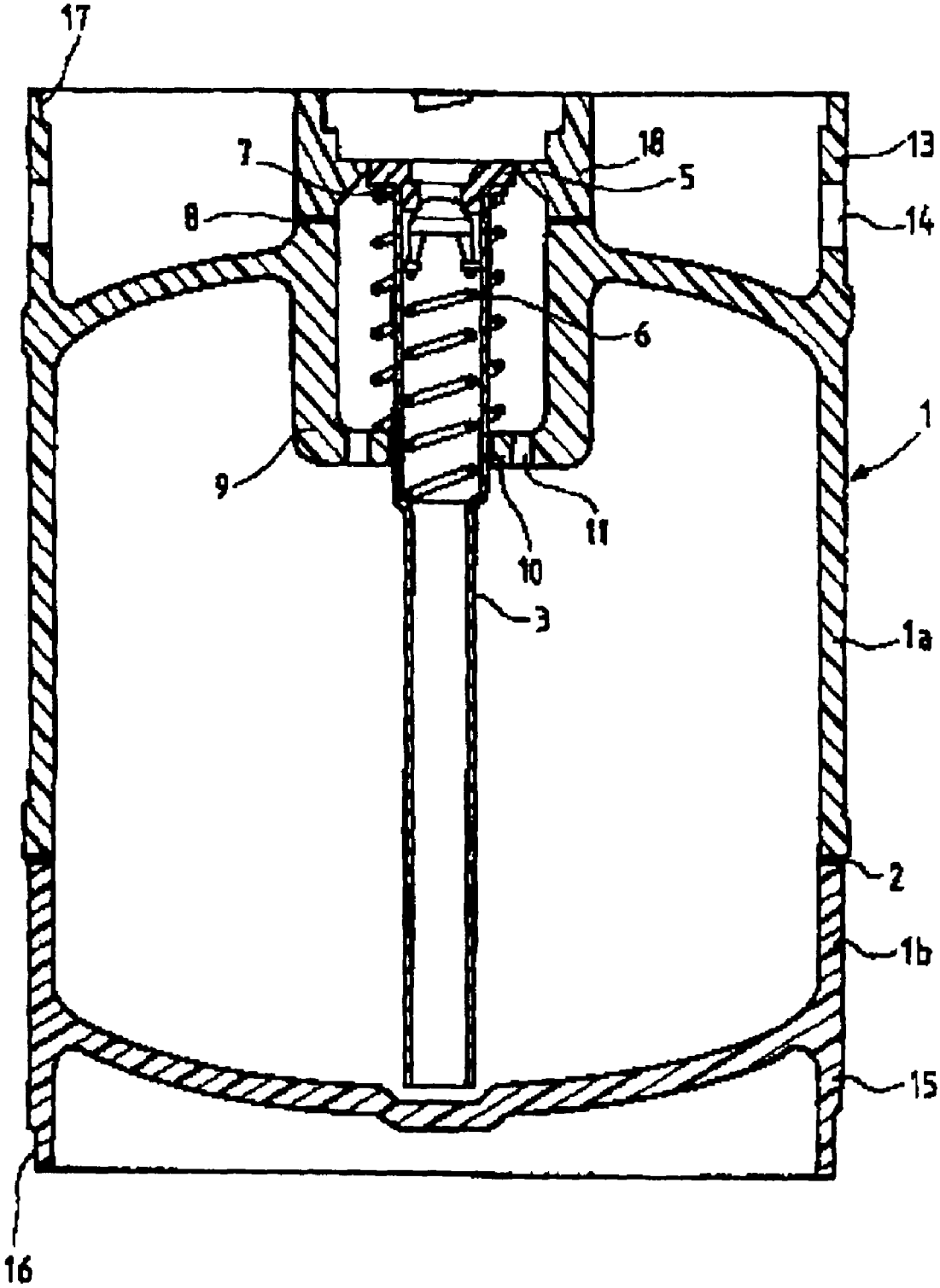
FIG. 2 represents a longitudinal schematic section of a variant of the container according to the invention.
Figure 5:
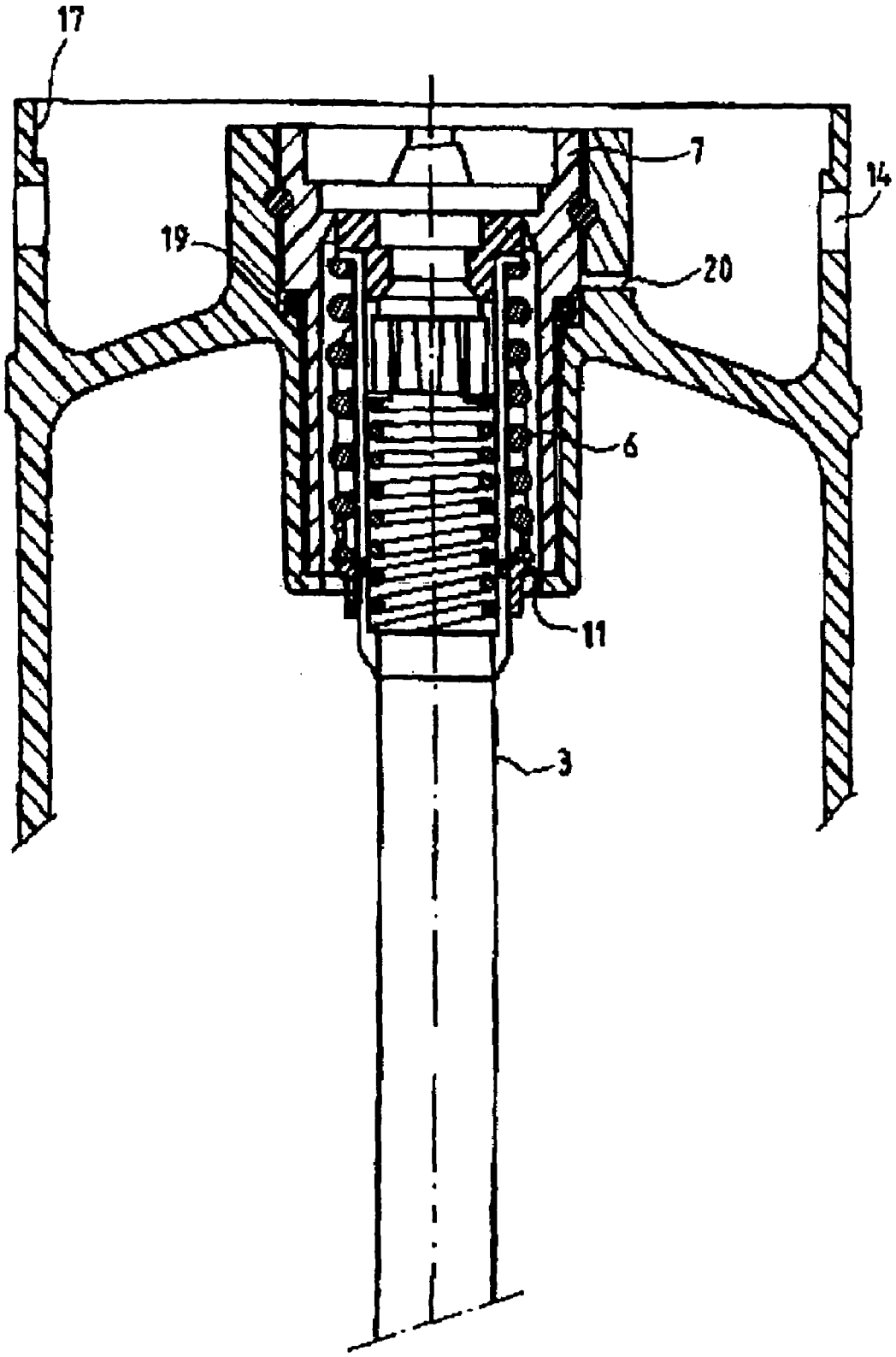
FIG. 5 represents a partial longitudinal schematic section of another variant of the container according to the invention.

In the embodiments according to FIGS. 1, 2 and 5, the container 1 has a plunger tube 3 with nondetachable head 4, fastened, for example, by a weld seam 8.

Figure 3:
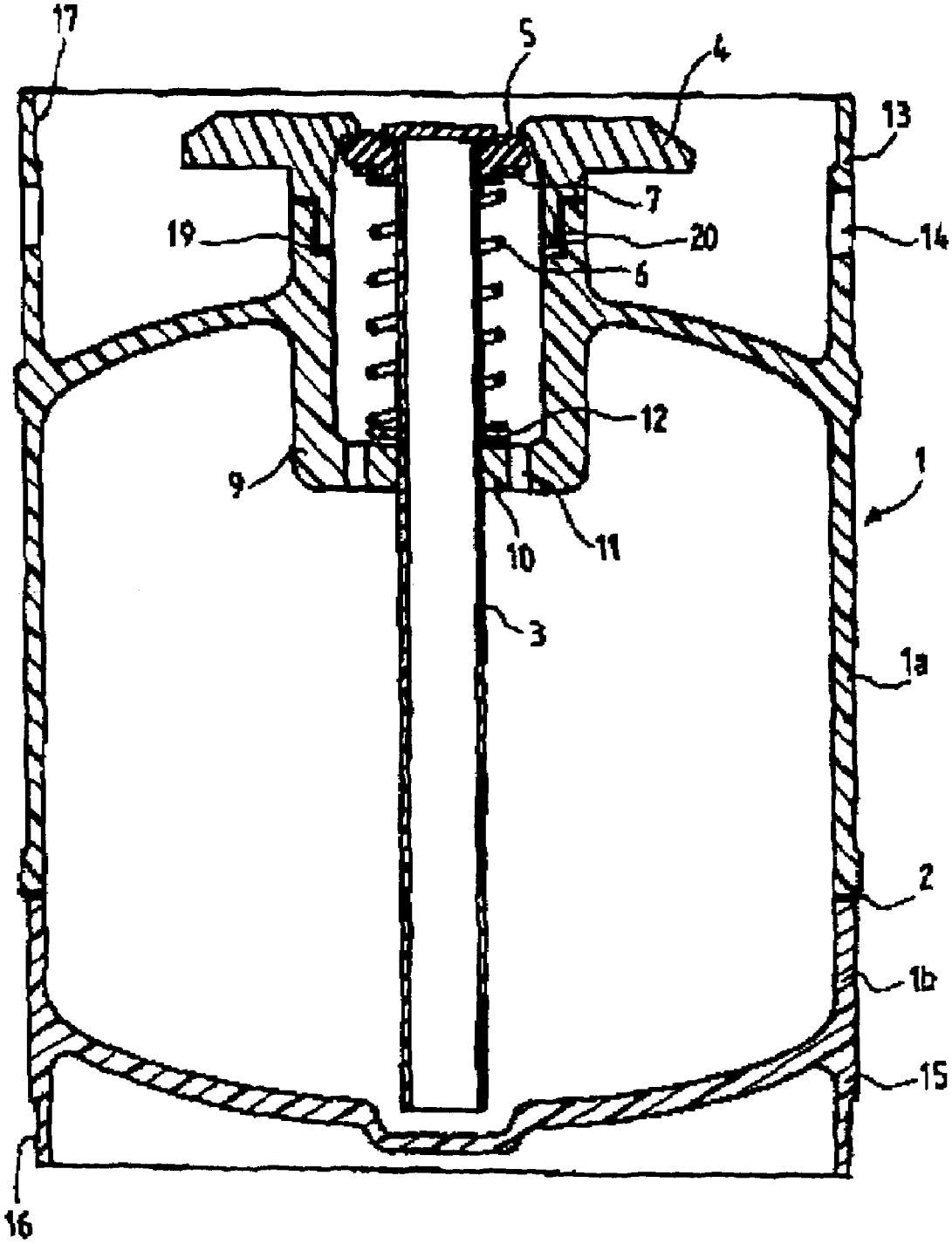
FIG. 3 represents a longitudinal schematic section of a variant embodiment of the container according to FIG. 1.
Figure 4:
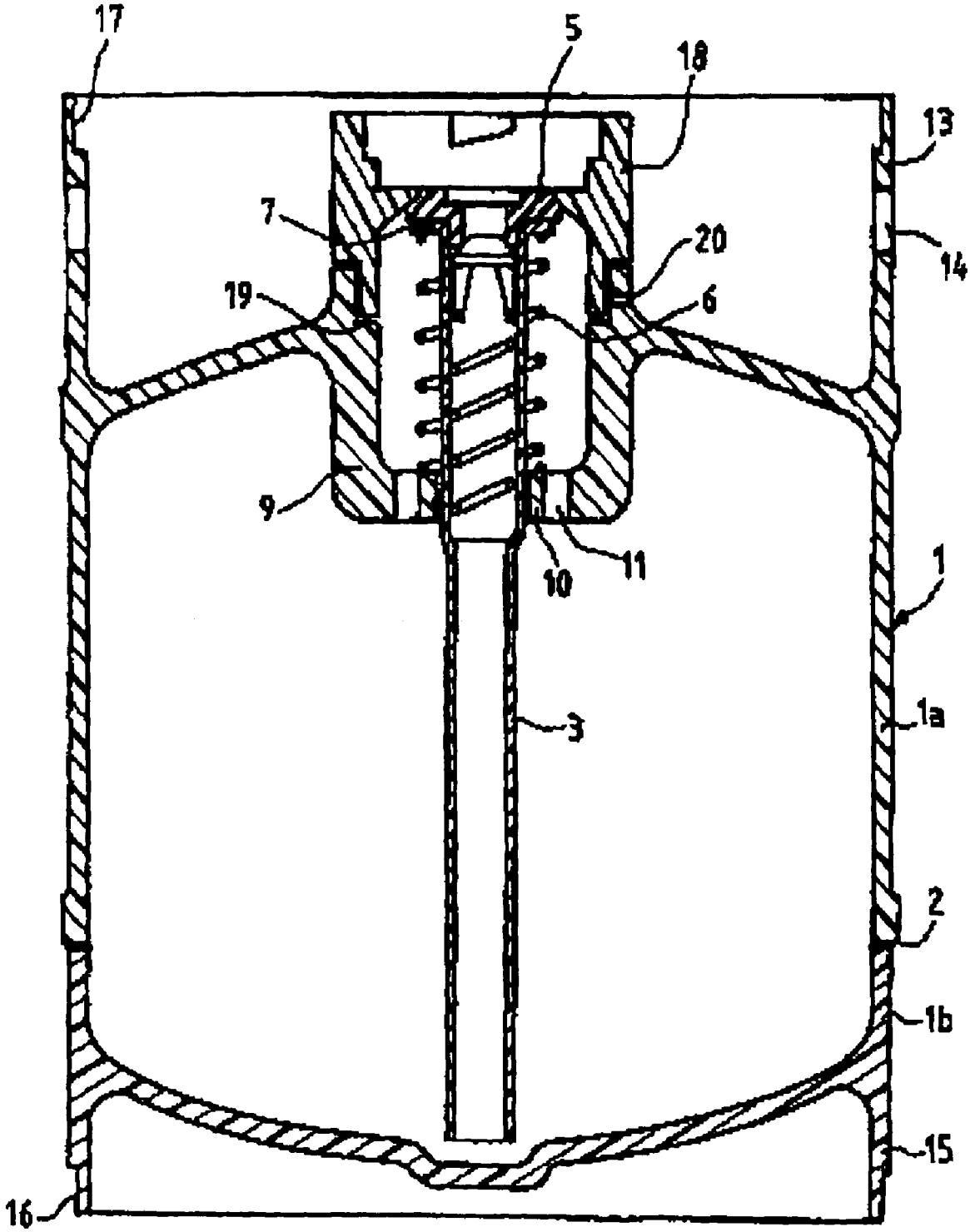
FIG. 4 represents a longitudinal schematic section of a variant embodiment of the container according to FIG. 2.

In the embodiments according to FIGS. 3, 4 and 5, the container 1 has a plunger tube 3 equipped with a screwable head 4, 18, in which case the upper part of the neck of the opening of the container 1 must have a thread (not represented) corresponding to that of said head.

In the embodiment according to FIG. 5, the container has a plunger tube 3 such as the one used in the fluid container according to patent WO 95/31671.

A plunger tube 3 with flat head 4 is represented in FIGS. 1 and 3, while the plunger tube, with which the containers according to FIGS. 2, 4, 5 and 6 are equipped, is of the type with hollow head 18. Those types of heads of the plunger tube or tapping pipe are known to the expert.

In that embodiment of the plunger tube, the latter contains a flange 12 intended to bear on the bottom of the housing defined by the inner portion of the neck of the container 1 and the re-entrant part of said inner portion.

In the container 1 according to the invention, the inner part 9 of the neck of the opening advantageously contains, at or near its inner end, a re-entrant part defining a bottom 10, equipped with a center opening of dimension sufficient to allow the plunger tube 3 to pass with just enough clearance to permit their reciprocal displacement by translation. The bottom 10 of the re-entrant part of the neck of the container 1 has at least one opening 11, the essential function of which is to allow passage of the liquid on filling and of the gases on tapping of said liquid. Said openings 11 can be of any shape, such as round or oval.

In one embodiment represented in FIGS. 1 and 3, the plunger tube 3 bears on the bottom of the neck of the opening of the container 1 by means of a flange 12.

The above-mentioned gasket 5 is of suitable shape to ensure tightness of the keg and also to permit tapping by means of a tapping valve of suitable known type, in practice a tapping valve specially designed for that service. The spring 6 keeps the gasket 5 in place.

The upper peripheral part of the keg, when the latter is placed on its bottom, contains a portion 13 called upper skirt, in which it is advantageous for cut-outs to be provided, of size sufficient for the portion of the skirt situated above them to form a handle 14, in order to facilitate handling of the keg.

In one advantageous embodiment, the part forming the bottom of the container also defines a peripheral skirt 15, which can be provided or not with cut-outs facilitating handling. The low peripheral skirt 15 preferably ends in offsets 16 homothetic with offsets 17 provided in the terminal portion of the upper skirt 13, which makes it possible to place the keg according to the invention in vertical position and to pile or stack at least two kegs on top of each other. In the embodiments such as represented in FIGS. 3 to 5, according to which the plunger tube is mounted by screwing on the neck of the container 1, preferably with at least one gasket 19, it is particularly advantageous to provide at least one vent 20 in the area of threading of the neck of the opening of the container 1 and/or in the area of threading of the head 4, in order to permit depressurization of the contents of the keg from the start of disconnection of the plunger and thus avoid the ejection of said head under the effect of overpressure.

Figure 6:
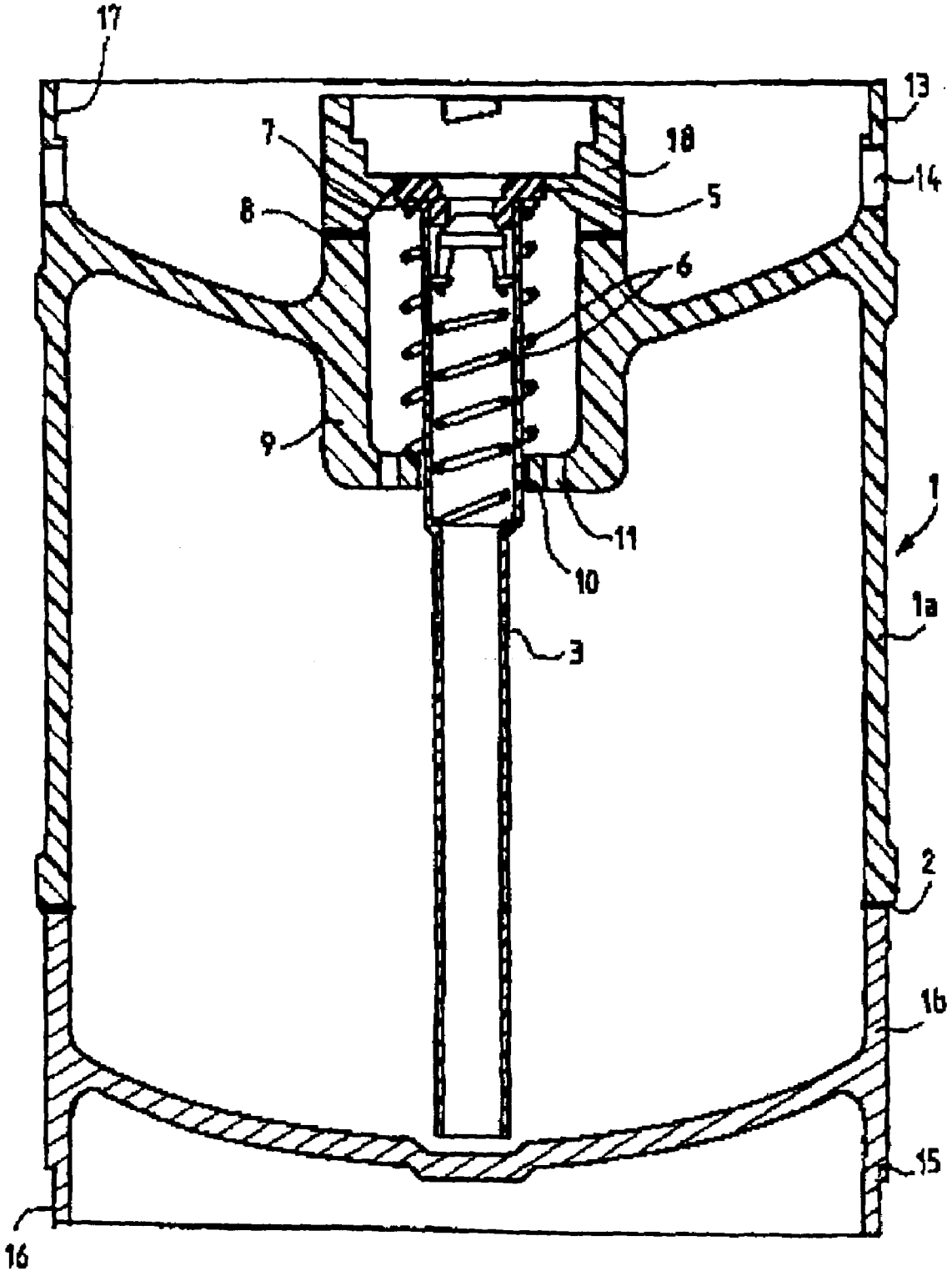
FIG. 6 represents a longitudinal schematic section of another variant embodiment of the container according to FIG. 2.

The variants of the keg according to the invention represented in FIGS. 1, 2 and 6 each contain a nondetachable welded plunger tube.

Thus, according to the invention, the plunger tube 3 can advantageously be specific to the container 1 and be made in the same way as the container 1.

The embodiments of the keg according to the invention, represented in FIGS. 1 and 3, contain a plunger tube with so-called flat head, while those of FIGS. 2, 4, 5 and 6 contain a plunger tube with so-called hollow head.

Figure 7:
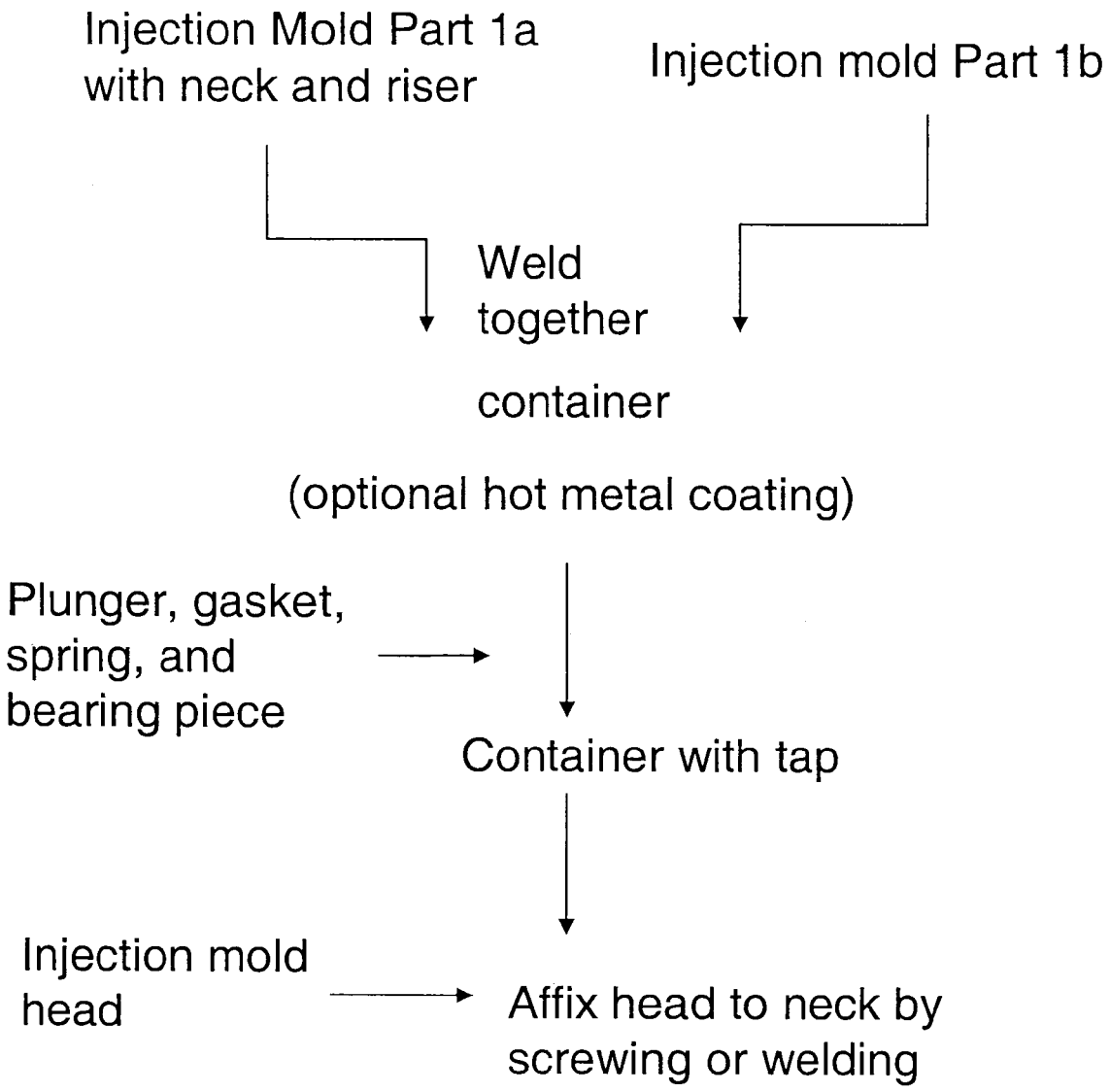
FIG. 7 shows the method of the invention.

In order to make a keg according to the invention, the following stages are undertaken as outlined in FIG. 7:

parts 1*a* and 1*b* of the container are injection-molded, as is, by option, a head 4, 18 appropriate to the type of plunger tube envisaged, the above-mentioned parts 1*a* and 1*b* are welded together, the pieces consisting of a plunger tube 3, a peripheral gasket 5, a spring 6 and a bearing piece 7 are mounted on the neck of part 1*a*, and a head 4, 18 is welded or is screwed on the external portion of the neck of the opening of the container 1.

Such fabrication of the container by injection molding and welding and/or screwing of the pieces guarantees perfect geometry and good distribution of the resistance to pressure of the finished keg.

The outer shapes that can thus be easily obtained have the advantage of making it possible to treat the kegs on the same filling lines as those in operation at present for stainless steel kegs.

The keg according to the invention has the considerable advantage of being compatible with the existing filling and tapping systems. In particular, in cafés, bars and brasseries where kegs are used for dispensing beverages, there now appear to be two types of tapping valves, which are both widely used. They are the so-called "flat head" and "hollow head" valves, which have the types of plunger tube heads referred to above (see FIGS. 1-3 and 2-4-5, respectively). Thus, the different embodiments of the present invention ensure total compatibility with the existing tapping valves, and the invention provides for at least one embodiment for each of the systems with which beverage dispensers are at present equipped.

In addition, as has been described above, with reference to the attached drawings, the tapping pipe is advantageously of one of the two types respectively illustrated in FIGS. 1-3, on the one hand, and in FIGS. 2-4-5-6, on the other.

The pressurization system and the other elements completing the device on the tapping site are of standard type, that is, of the type of those known to the expert.

The invention provides, as an additional advantage, for kegs for one-time use, the liquid tapping devices of which can by choice be either welded or detachable. However, even if the concept of a container for one-time use is preferred, the same product could, if desired, be recovered, washed, dried and refilled, but on condition that it corresponds to the embodiment with detachable plunger tube.

However, as has been shown above, the neck of the container according to the invention has a particular shape rendering the complete washing and drying of a recycled container impossible or very tedious and, therefore, ultimately incompatible with the productivity requirements applicable to this type of product.

These elements actually afford an undeniable advantage to the product according to the invention, for the latter can, in contrast to existing comparable products, be for one-time use. Such a keg for one-time use, also called "disposable" keg, makes it possible to avoid the costs of storage, repair and return of recycled kegs, which is the case with the present stainless steel kegs. Instead of being thrown away after use and thus being a cost and environmental pollution factor, a keg according to the invention can be recycled; that is, after possible separation of the plunger tube, if the materials of the latter have to be treated separately, that keg can be ground up after collection and converted into reusable material close to the scrapping site.

In the embodiment containing the high and low skirts and the offset described above, the kegs according to the invention also have the advantage of being stackable, which is not the case with the present stainless steel beer kegs, which must be palletized in single rows, thus requiring greater floor space for storage.

The materials recommended for the kegs according to the invention are capable of absorbing shocks, which are common on the handling and transportation of such kegs. They enable the kegs to recover their shape and their initial dimensions by resiliency, something that cannot be accomplished with the present stainless steel kegs, which thereby undergo a high rate of loss and risk having their contents diminished.

The invention claimed is:

1. Keg for tapping liquids under the effect of pressure, comprising:

(A) a shaped jacket or liner forming a container (1) having an internal lumen, obtained from at least two nonsymmetrical parts (1*a*, 1*b*) welded together, one of said parts containing an opening provided with a neck and a riser or upper peripheral skirt (13) circumferentially surrounding the neck, and (B) a filling/tapping device (3) positioned in the neck of said opening, wherein neither the neck nor the filling/tapping device have a height such that they extend beyond the riser or upper peripheral skirt (13), wherein the neck of said opening contains a part (9) extending inside the lumen, said part (9) having an opening at its end (10), so as to permit passage and maintenance of the filling/tapping device (3), and having at least one other opening (11) connecting with the lumen, wherein the filling/tapping device (3) allows passage of liquid to and through the other opening (11) into the lumen upon filling the keg with said liquid and allows passage of gas to and through the other opening (11) upon tapping said liquid from the keg.

2. Keg according to claim 1, wherein the keg is formed by injection molding of a thermoplastic material.

3. Keg according to claim 1, wherein the jacket or liner is made of a material selected from the group consisting of high-density polyethylene, high-density polypropylene, PVC and ABS.

4. Keg according to claim 1, wherein the jacket or liner is made of a material selected from the group consisting of high-density polyethylene, high-density polypropylene, PVC and ABS.

5. Keg according to claim 4, further comprising an outer coating formed by hot metal plating.

6. Keg according to claim 1, wherein the height of said riser or peripheral skirt (13) is sufficient to be able to contain at least one cut-out forming a handle (14).

7. Keg according to claim 1, wherein the other opening(s) (11) is (are) situated on the periphery of said opening for passage and maintenance of the tapping device (3).

8. Keg according to claim 1, wherein the filling/tapping device comprises a plunger tube with non-detachable head.

9. Container for making a keg, comprising:

a shaped jacket or liner forming a container (1) having an internal lumen, obtained from at least two nonsymmetrical parts (1*a*, 1*b*) welded together, one of said parts containing a filling/tapping opening provided with a neck and a riser or peripheral skirt (13) wherein the neck of said opening contains a part (9) extending inside the lumen, the part (9) having an opening at its end (10), and having at least one other opening (11) connecting with the lumen wherein the filling/tapping device (3) allows passage of liquid to and through the other opening (11) into the lumen upon filling the keg with said liquid and allows passage of gas to and through the other opening (11) upon tapping said liquid from the keg.

10. Container according to claim 9, the part (1*b*) forming the bottom of said container defines a lower peripheral skirt (15).

11. Container according to claim 10, wherein the lower peripheral skirt has a tapered portion which is complementary to tapered portion on the riser or upper peripheral skirt to facilitate stacking of containers.

12. Container according to claim 9, wherein the shaped jacket or liner is formed by injection molding of a thermoplastic material.

13. Container according to claim 9, wherein the jacket or liner is made of a material selected from the group consisting of high-density polyethylene, high-density polypropylene, PVC and ABS.

14. Container according to claim 9, further comprising an outer coating formed by hot metal plating.

15. Container according to claim 9, wherein the height of said riser or peripheral skirt (13) is sufficient to be able to contain at least one cut-out forming a handle (14).

16. Method of fabrication of a keg, comprising the steps of:

injection molding at least two nonsymmetrical parts (1*a*, 1*b*), one of said parts containing an opening provided with a neck and a riser or upper peripheral skirt (13) circumferentially surrounding the neck, welding parts (1*a*) and (1*b*) together to form a container, said container having an internal lumen, wherein the neck of said opening contains a part (9) extending inside the lumen and having an opening at its end (10), so as to permit passage and maintenance of a filling/tapping device (3), and having at least one other opening (11) connecting with the lumen, wherein the filling/tapping device (3) allows passage of liquid to and through the other opening (11) into the lumen upon filling the keg with said liquid and allows passage of gas to and through the other opening (11) upon tapping said liquid from the keg, mounting a plunger tube (3), a peripheral gasket (5), a spring (6) and a bearing piece (7) on the neck of part (1*a*) of the container, and attaching a head (4, 18) by welding or screwing on the external portion of the neck of the opening of the container (1), wherein neither the neck nor the filling/tapping device have a height such that they extend beyond the riser or upper peripheral skirt (13).

* * * * *